US005161321A

United States Patent [19]

Kuhnke

[11] Patent Number: 5,161,321

[45] Date of Patent: Nov. 10, 1992

[54] DISPLAY SYSTEM UTILIZING PIVOT ARMS, OVER CENTER SPRING, AND DISPLAY PANEL ROTATABLE AT LEAST 180 DEGREES

[76] Inventor: Horst F. Kuhnke, 2403 Greshan Ct., Arlington Heights, Ill. 60004

[21] Appl. No.: 667,041

[22] Filed: Mar. 8, 1991

[51] Int. Cl.[5] ..... G09F 11/02

[52] U.S. Cl. ..... 40/493; 40/497; 40/530; 248/486; 434/421

[58] Field of Search ..... 40/492, 508, 530, 533, 40/535, 531, 493, 497, 501, 534; 52/32, 29; 248/479–487; 16/291, 293; 434/402, 414, 421, 419, 420; 49/386

[56] References Cited

U.S. PATENT DOCUMENTS

| | | | |
|---|---|---|---|
| 241,925 | 5/1881 | Cadwell | 40/493 |
| 401,921 | 4/1889 | Anderson | 248/486 |
| 1,893,624 | 1/1933 | Jay | 16/291 X |
| 3,176,942 | 4/1965 | Mitchell et al. | 248/487 |
| 3,293,632 | 12/1966 | Blume | 52/32 |

FOREIGN PATENT DOCUMENTS

| | | | |
|---|---|---|---|
| 70049 | 9/1915 | Fed. Rep. of Germany | 434/419 |
| 87024 | 4/1921 | Fed. Rep. of Germany | 434/419 |

*Primary Examiner*—Kenneth J. Dorner
*Assistant Examiner*—James M. Gardner
*Attorney, Agent, or Firm*—Allegretti & Witcoff, Ltd.

[57] ABSTRACT

This invention relates to apparatus for display and storage, and more particularly relates to an reversible wall panel system for storage and display. The apparatus provides approximately double the useable space of the area on which it is mounted. The apparatus is comprised of a panel rotatably mounted on a frame via integral pivot arms. Springs help maintain an essentially coplanar relationship between the panel and frame.

5 Claims, 2 Drawing Sheets

Fig. 1
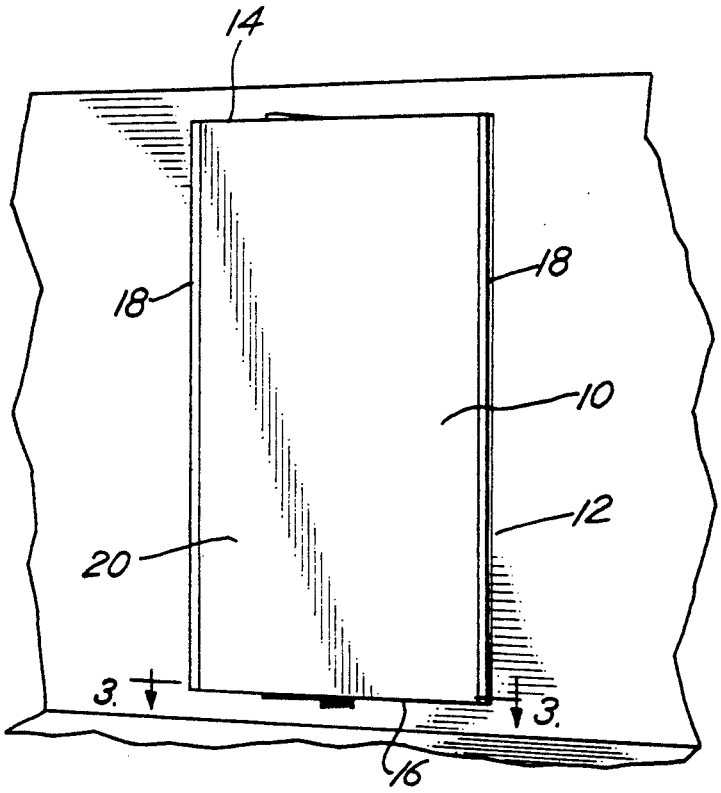
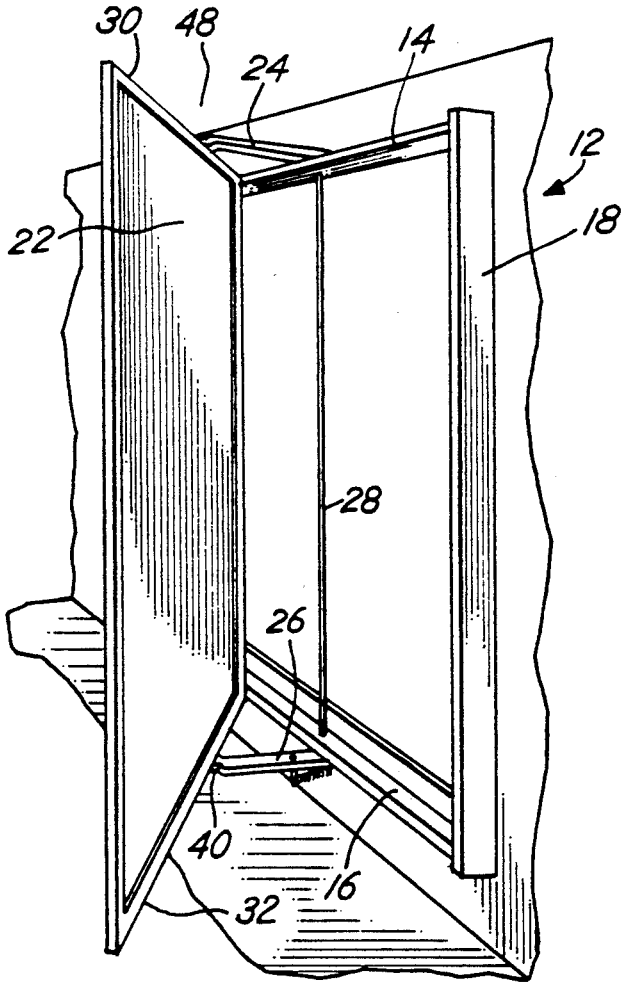
Fig. 2

DISPLAY SYSTEM UTILIZING PIVOT ARMS, OVER CENTER SPRING, AND DISPLAY PANEL ROTATABLE AT LEAST 180 DEGREES

FIELD OF THE INVENTION

This invention relates to apparatus for display and storage, and more particularly relates to an reversible wall panel system for storage and display, which can be used to essentially double the usable space of an area in which the apparatus is mounted.

BACKGROUND OF THE INVENTION

In many rooms, information display, decoration, and/or storage is necessary. For instance, information display can be used in offices, advertising agencies, classrooms, and board rooms. The present invention comprises a reversible display/storage panel ("panel"). In an office, the panel can have messages on one side and things to do on the other side. In an advertising agency, the panel may have a first advertising idea on one side and a second advertising idea on the other side. In a board room, the panel may have prior sales on one side and sales forecasts on the other side. In a room at home, the panel may have wallpaper on one side and paint on the other. There are advantages associated with each of the ways to use the present invention.

The present invention satisfies the desire to redecorate by allowing an area, such as a wall or room, to appear to be wallpapered one minute and by reversing the panel, appear to be painted the next minute. Also, the invention is useful for presentations where one can present double the information one normally could while having the audience still focus on the same area of the wall. This particular feature is useful for people giving presentations, for instance, teachers, advertising personnel and marketing/sales personnel. Although just some of the advantages of the present invention have been mentioned, the list of advantages that can be afforded by having an apparatus essentially double the area of usable space which it is mounted on is an endless list. The common thread that runs between all of the above examples is that a given area of wall space can be used to display and/or store approximately twice the information it normally could because the panel essentially serves to double the area of usable space on which the apparatus is mounted.

Accordingly, it is a primary object of the present invention to provide an apparatus for displaying information over an area approximately two times the size as the wall space it occupies.

Another object of the present invention is to provide an apparatus for decorating an area in two different, easily interchangeable ways. Other objects and advantages of the present invention will be made more apparent hereinafter.

SUMMARY OF THE INVENTION

The present invention is useful in any room to essentially double the area of usable space on which the device is mounted. Essentially, the device comprises a frame fixedly mounted to a wall and a panel, approximately the same size as the frame, mounted to the frame. The panel is rotatably mounted on the frame. On one side, the panel contains information and/or decoration. On the other side, the display panel also contains information and/or decoration.

The reversible wall panel system for storage and display comprises, in its simplest form, a mounting means, a first pivot means, a display means and a bias means. The mounting means is essentially planar and has an outer periphery and an inner periphery. Further, the mounting means is adapted to be fixedly attached to an essentially planar surface, such as a wall. The first pivot means has a first end and a second end. The first end of the first pivot means is rotatably attached to the outer periphery of the mounting means. The display means is essentially planar and its outer periphery is rotatably attached to the second end of the first pivot means. The bias means biases the first pivot arm so that the display means and the mounting means are essentially co-planar. The bias means has a first end and a second end. The first end of the bias means is attached to the outer periphery of the mounting means and the second end of the bias means is attached to the first pivot means at a point between the first end of the first pivot means and the second end of the first pivot means. Thus, as the mounting means and the display means are moved away from their biased co-planar positions, the bias means is deformed in such a way that it exerts a bias force which tends to bring the mounting means and display means back into an essentially co-planar relationship.

In addition to the structures and features described above, the apparatus can be comprised of additional structures and/or features. These additional structures and/or features allow for a more efficient and effortless use of the apparatus. There are at least three additional structures, or features of structures described above, which aid in providing a more efficient, easier to use apparatus.

First, the apparatus has a second pivot means for pivoting the display means with respect to the mounting means. The second pivot means has a first end and a second end. The first end of the second pivot means is rotatably attached to the outer periphery of the mounting means and the second end of the second pivot means is rotatably attached to the outer periphery of the display means. The axis of rotation of the panel is defined by the line between the second end of the first pivot means and the second end of the second pivot means.

Second, the first pivot means and the second pivot means of the apparatus are essentially L-shaped. The L-shaped first pivot means and the L-shaped second pivot means both have a first end, a second end, and an elbow. The elbow of each pivot means functions to connect the first end of the first and second pivot means with the second end of the first and second pivot means, respectively. The second ends of the first and second pivot means are rotatably attached to the outer periphery of the display means. Further, they are attached at opposite ends of the display means in such a way as to form a pivot axis, about which the display means pivots. The pivot axis is defined by an imaginary line drawn from the second end of the first pivot means to the second end of the second pivot means. The first ends of both the first and second pivot means are rotatably mounted in a first and a second essentially cylindrical cavity, respectively, of the mounting means. These cavities allow the second ends to emanate from the inner periphery of the mounting means, where they can be rotatably secured to the mounting means by, for instance, a pin.

Third, the apparatus has a connecting means having a first end and a second end. The first end of the connecting means is fixedly connected to the first end of the first pivot means by, for instance, a cotter pin. Also, the second end of the connecting means is fixedly connected to the first end of the second pivot means.

The above described invention allows one to have, at his or her disposal, an area for display and/or storage that is essentially double the size of the area needed to mount the device.

BRIEF DESCRIPTION OF THE DRAWINGS

These and other objects, advantages and features of the invention will hereafter appear for purposes of illustration, but not of limitation, in connection with the accompanying drawings in which like numbers refer to like parts throughout and in which:

FIG. 1 is a perspective view of a preferred form of a panel made in accordance with the present invention;

FIG. 2 is a perspective view illustrating the manner in which the display means is interconnected to the mounting means;

DETAILED DESCRIPTION OF THE PREFERRED EMBODIMENT

Figure 3:
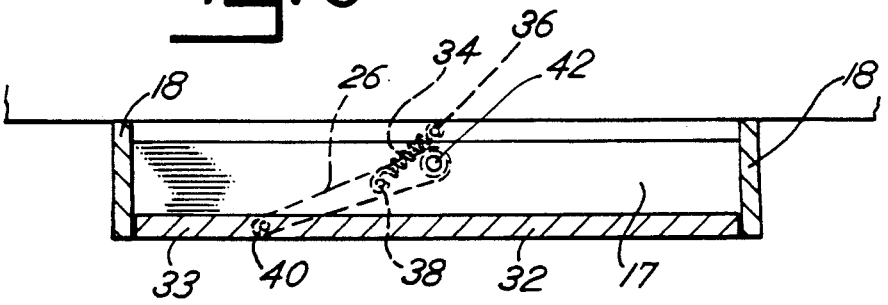
FIG. 3 shows a detailed bottom view of the preferred form of the invention.

The present invention, in its preferred embodiment shown in FIG. 1, has a panel 10 (display means) and a frame 12 (mounting means). The frame 12 has a top 14, a bottom 16 and two sides 18. The bottom 16 of the frame 12 has a lower surface 17 where other elements of the present invention are attached (see FIG. 3). The frame 12 may be rectangular as shown in FIG. 1, or any other shape. Regardless of the shape of the frame, the frame has an outer and inner periphery, the outer periphery being formed by the outer circumference of the frame 12 and the inner periphery being formed by the inner circumference of the frame 12. The frame 12 is constructed of planks of wood or other suitable material. The panel 10 has a first side 20 and a second side 22 (see FIG. 2). The panel also has an outer periphery defined by the outer circumference of the panel 10. The panel 10 is rotatably attached, so that the panel can rotate 180 degrees, to the frame 12 by a first pivot arm 26 (first pivot means) and a second pivot arm 24 (second pivot means) (see FIG. 2). The first pivot arm 24 and the second pivot arm 26 are L-shaped and are connected by a connecting rod 28 (connecting means) as shown in FIG. 4. The line between a second end 40 of the first pivot arm 26 and a second end 48 of the second pivot arm 24 serves as an axis of rotation for the panel 10. In order to permit the panel 10 to rotate, the first pivot arm 26 should be connected to the middle of the bottom 16 of the frame 12 and the bottom 32 of the panel 10 (see FIG. 3). The bottom 32 of the panel 10 has a lower surface 33 where other elements of the present invention are attached (see FIG. 3). Also, the second pivot arm 24 should be connected to the middle of the top 14 of the frame 12 and the top 30 of the panel 10 (see FIG. 2).

Referring to FIG. 1, the preferred form of the present invention is comprised of a panel 10 and a frame 12. The frame 12 has a top 14, a bottom 16, and two sides 18. The panel 10 has a first side 20 and a second side 22 (see FIG. 2).

Referring to FIG. 2, the panel 10 is connected to frame 12 via a first pivot arm 26 and a second pivot arm 24. The first pivot arm 26 and the second pivot arm 24 are interconnected via a connecting rod 28. The first pivot arm 26 is connected to the bottom 16 of the frame 12 at essentially its lengthwise midpoint. The first pivot arm 26 is also connected to the bottom 32 of the panel 10. The second pivot arm 24 is connected to the top 14 of the frame 12 at essentially its lengthwise midpoint. The second pivot arm 24 is also connected to the top 30 of the panel 10. The second side 22 of the panel 10 is also shown.

Figure 4:
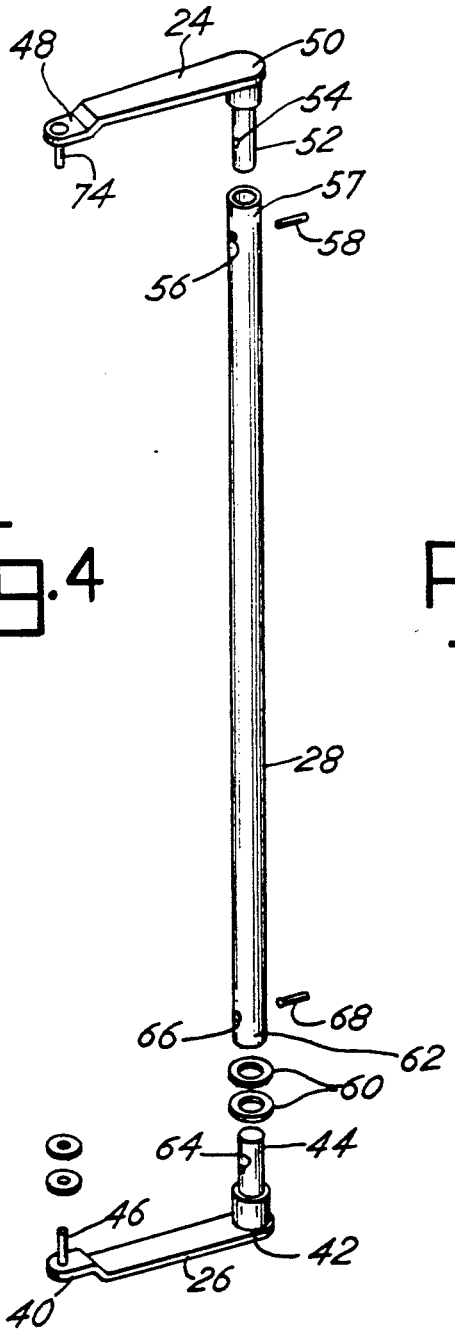
FIG. 4 is an exploded elevation view illustrating the structure used to rotatably attach the panel to the mounting means in the preferred form of the invention.

Referring to FIG. 3, bias spring 34 (bias means), has a first end 36 and a second end 38. The first end 36 of the bias spring 34 is fixedly attached to the bottom 16 of the frame 12 at essentially its lengthwise midpoint. The second end 38 of the bias spring 34 is attached to the first pivot arm 26 at a point between the second end 40 and the elbow 42 of the first pivot arm 26. When the first side 20 of the panel 10 is displayed (see FIG. 1), the bias spring 34 is in its relaxed state. However, as one begins to display the second side 22 of panel 10, the bias spring 34 is tensioned, increasing its potential energy. Once the second side 22 of the panel 10 is in place such that it is essentially co-planar with the frame 12, the bias spring 34 is once again in a relaxed state and helps secure the panel 10 to the frame 12.

Referring to FIG. 4, the first pivot arm 26 has a first end 44, an elbow 42, a second end 40 and a pivot pin 46. The second pivot arm 24 is comprised of a first end 52, an elbow 50, a second end 48, and a pivot pin 74. In its preferred form, the first end 52 of the second pivot arm 24 is slid through a hole in the top 14 of the frame 12 (not shown) at essentially its lengthwise midpoint. The first end 52 of the second pivot arm 24 has a hole 54 which aligns with another hole 56 near a second end 57 of the connecting rod 28 when the first end 52 of the second pivot arm 24 is slid into the connecting rod 28. Once hole 54 of the first end 52 and hole 56 of the connecting rod 28 are aligned, the pin 58, commonly a cotter pin, can be inserted through both holes 54 and 56 to secure the first end 52 of the second pivot arm 24 to the second end 57 of the connecting rod 28.

Figure 5:
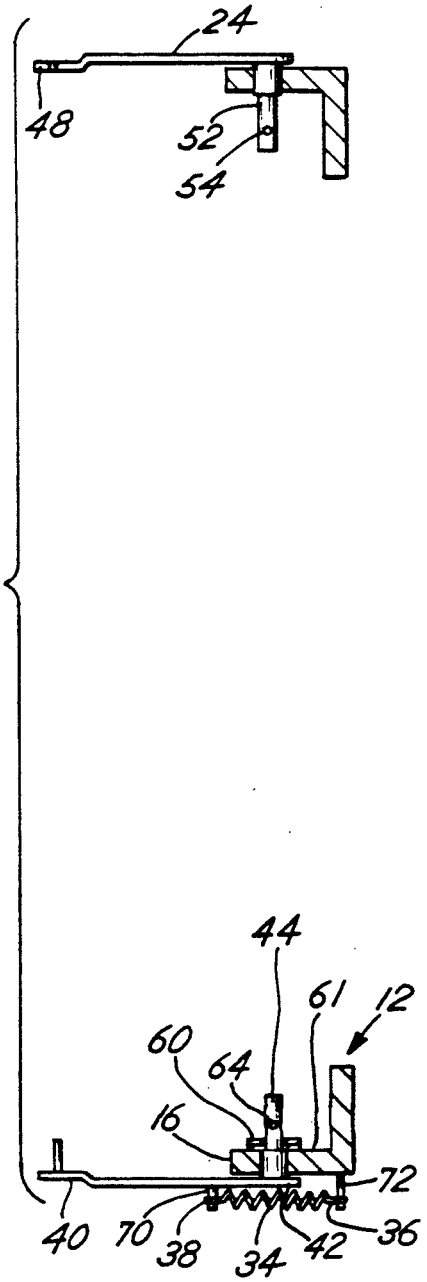
FIG. 5 is a detailed elevation view of the manner in which the panel is rotatably attached to the bottom of the mounting means.

Referring to FIG. 5, the first end 44 of the first pivot arm 26 is slid through a hole in the bottom 16 of the frame 12 at essentially its lengthwise midpoint. A plurality of washers 60 are slipped over the first end 44 of the first pivot arm 26 and rest on the upper surface 61 of the bottom 16 of the frame 12. A first end 62 of connecting rod 28 is slid over the first end 44 of the first pivot arm 26. When the hole 64 of the first end 44 of the first pivot arm 26 is aligned with a hole 66 near the first end 62 of the connecting rod 28 (see FIG. 4), a pin 68 is slid through hole 64 and hole 66 securing the first end 62 of the connecting rod 28 to the first end 44 of the first pivot arm 26. A pivot pin 70 emanates from the first pivot arm 26 at a point between the second end 40 and the elbow 42. The second end 38 of the bias spring 34 is attached to the first pivot arm 26 at the pivot pin 70. Emanating from the bottom 16 of the frame 12 is another pivot pin 72. The first end 36 of the bias spring 34 is attached to the pivot pin 72. A pivot pin 46 of the first pivot arm 26 and a pivot pin 74 of the second pivot arm 24 enter holes in the bottom and top, respectively, of the panel 10, and allow the panel 10 to freely rotate when the bias spring 34 is in its tensioned state (see FIG. 4).

Although the invention has been described in detail with particular reference to an illustrative preferred embodiment thereof, many variations and modifications can be made to the preferred embodiment. For instance, the panel 10 can be attached to the frame 12 by only one pivot arm. In this case, the combination of the first pivot arm 26 and the bias spring 34 can be connected to the frame 12 and panel 10, and the frame 12 and first pivot arm 26, respectively. In this case, the first end 44 of the first pivot arm 26 is placed through a hole in the bottom 16 of the frame 12 at essentially its lengthwise midpoint. Once through the hole, pin 68 can slide through hole 64 in the first end 44 of the first pivot arm 42. This would serve to keep the first pivot arm 26 attached to the frame 12 while allowing the first pivot arm 26 to rotate with respect to the frame 12. This form of the present invention eliminates the need for the connecting rod 28 and the second pivot arm 24. While less expensive to produce, due to the fact that less parts are needed, the above described form of the present invention is one of the many variations and modifications that can be effected within the spirit and scope of the invention as described hereinabove and as defined in the appended claims.

What is claimed is:

1. A display system comprising:

(a) a mounting means for mounting the display system, the mounting means having an outer periphery, an inner periphery, and at least a first side and a second side that is parallel to the first side, the mounting means being essentially planar and adapted to be fixedly attached to an essentially planar surface;

(b) a display means for displaying both surfaces of an essentially planar surface, the display means having at least a first side and a second side that is parallel to the first side, the first and second sides of the display means being parallel to the first and second sides of the mounting means, the display means being connected to the mounting means;

(c) a first integral pivot means for pivoting the display means, the first integral pivot means having a first end and a second end, the first end being rotatably attached to the outer periphery of the mounting means at about the midpoint of the first side of the mounting means, the second end of the first integral pivot means being rotatably attached to an off-center point of the first side of the display means;

(d) a second integral pivot means for pivoting the display means, the second integral pivot means having a first end and a second end, the first end of the second integral pivot means being rotatably attached to the outer periphery of the mounting means at about the midpoint of the second side of the mounting means, the second end of the second integral pivot means being rotatably attached to an off-center point of the second side of the display means, the display means being able to rotate at least 180 degrees;

(e) connecting means for connecting the first integral pivot means and the second integral pivot means, the connecting means having a first end and a second end, the first end of the first integral pivot means and the first end of the second integral pivot means being fixedly attached to the first end and the second end, respectively, of the connecting means, the connecting means being substantially perpendicular to the first side and the second side of the mounting means, the second end of the first integral pivot means being rotatably attached to an off-center point of the first side of the display means, the display means being able to rotate at least 180 degrees; and (f) a bias means for biasing the first integral pivot means, the bias means having a first end and a second end, the first end of the bias means being attached to the first side of the mounting means and the second end of the bias means being attached to the first integral pivot means at a point between the first end of the first integral pivot means and the second end of the first integral pivot means, whereby in the most relaxed state of the bias means, the display means will be in essentially the same plane as the mounting means.

2. The apparatus as claimed in claim 1 further comprising a bias means for biasing the second integral pivot means, the bias means having a first end and a second end, the first end of the bias means being attached to the second side of the mounting means and the second end of the bias means being attached to the second integral pivot means at a point between the first end of the second integral pivot means and the second end of the second integral pivot means, whereby in the most relaxed state of the bias means, the display means will be in essentially the same plane as the mounting means.

3. A display means comprising:

(a) a frame, the frame having a top, a bottom, and two sides, the bottom having a lower surface, the top having an upper surface, the frame being essentially planar and adapted to be fixedly attached to a supporting surface;

(b) a first integral pivot arm having a first end and a second end, the first end being rotatably attached to the lower surface of the bottom of the frame at essentially a first lengthwise midpoint of the lower surface;

(c) a second integral pivot arm having a first end and a second end, the first end being rotatably attached to the upper surface of the top of the frame at essentially a first lengthwise midpoint of the upper surface;

(d) a connecting rod having a first end and a second end, the first end of the first integral pivot arm and the first end of the second integral pivot arm being fixedly attached to the first end and the second end, respectively, of the connecting rod;

(e) a bias spring, the spring having a first end fixedly attached to the lower surface of the bottom of the frame at a second lengthwise midpoint of the lower surface and a second end fixedly attached to the first integral pivot arm between the first end and the second end of the first integral pivot arm; and (f) a panel, the panel having a two essentially planar surfaces, a top, a bottom, and two sides, the top, bottom and two sides being essentially parallel to the top, bottom and two sides of the frame, respectively, the bottom having a lower surface, the top having an upper surface, the second end of the first integral pivot arm and the second end of the second integral pivot arm being rotatably attached to the lower surface of the bottom of the panel and the upper surface of the top of the panel at off-centered points, respectively, the panel being able to rotate at least 180 degrees.

4. The apparatus as claimed in claim 3 further comprising a bias spring, the spring having a first end fixedly attached to the upper surface of the top of the frame at a second lengthwise midpoint of the upper surface and a second end fixedly attached to the second integral pivot arm between the first end and the second end of the second integral pivot arm.

5. The apparatus as claimed in claim 3 wherein the connecting rod is fixedly attached to the first ends of the first integral pivot arm and the second integral pivot arm by cotter pins.

* * * * *